US006468025B1

(12) United States Patent
Stumpf et al.

(10) Patent No.: US 6,468,025 B1
(45) Date of Patent: Oct. 22, 2002

(54) BLANK SEPARATION METHOD AND APPARATUS

(75) Inventors: Peter Stumpf, Guelph; Roman Z Tracz; Tai C Fok, both of Mississauga; Chad D Van Dam, Brampton; Luciano J Bosco, Oakville; William L Kishonti, Toronto; Steve K T Yeung, Mississauga, all of (CA)

(73) Assignee: ABB Inc., Brampton (CA)

( * ) Notice: Subject to any disclaimer, the term of this patent is extended or adjusted under 35 U.S.C. 154(b) by 0 days.

(21) Appl. No.: 09/311,017

(22) Filed: May 13, 1999

(51) Int. Cl.[7] ..... B65B 59/02

(52) U.S. Cl. ..... 414/797; 414/796.5; 414/797.1; 414/796.6; 271/8.5 D

(58) Field of Search ..... 414/797, 796.5, 414/797.1, 796.6; 271/8.5 D

(56) References Cited

U.S. PATENT DOCUMENTS 3,724,687 A * 4/1973 Marschke et al. ..... 271/26 R
4,743,006 A * 5/1988 Boille et al. ..... 271/18.1
4,806,071 A * 2/1989 Sartorio ..... 414/786
5,256,030 A * 10/1993 Tanaka et al. ..... 414/798.8
5,352,086 A * 10/1994 Mank ..... 414/797

FOREIGN PATENT DOCUMENTS

| | | | | |
|---|---|---|---|---|
| DE | 3310990 | * | 9/1984 | ..... 414/797 |
| EP | 190754 | * | 8/1986 | ..... 414/797 |
| JP | 6830 | * | 1/1983 | ..... 414/797 |
| JP | 404032422 | * | 2/1992 | ..... 414/797 |

* cited by examiner

*Primary Examiner*—Joseph A. Fischetti

(57) ABSTRACT

It is known to utilize magnets to assist in separating individual blanks from a stack of blanks. The invention utilizes a pressurized fluid, for example pressurized air, to separate one blank from another. The pressurized air system is utilized in a combination with a pick up device which can pick up individual blanks which are separated from a stack with the assistance of the pressurized air system. Suction cup assemblies located, and providing lift, at the edges or corners of the blank can operate to assist in peeling upwards the edges or corners of the top blank on the stack. These edge or corner mounted suction cup assemblies may be actuated by reciprocadg air cylinders, and may work in conjunction with the pressurized air system.

42 Claims, 10 Drawing Sheets

BLANK SEPARATION METHOD AND APPARATUS

The present invention relates to methods and apparatus for separating individual blanks from a stack of blanks, and has particular application in the automotive body fabrication field.

BACKGROUND OF THE INVENTION

Body parts for certain vehicles are fabricated from several body blanks. In the automotive industry, these blanks have for the most part, been made of steel thus producing steel bodied automobiles, trucks, etc. More recently there has been a trend in the automotive industry in particular, to move towards the use of aluminium to produce partial or entire aluminium bodied vehicles.

In the body fabricating process, blanks are typically delivered to an input end of an assembly line process in a stacked arrangement. One at a time, these blanks are then transferred from the stack and fed into the fabrication system on a continuous basis. To feed the blanks into the system it is necessary to separate one blank from the stack so that a single blank at a time can be fed serially into the assembly line system. However, in the blank fabrication process itself, a lubricating fluid is used when making the blanks to assist in preventing damage and prevent oxidation as one blank is placed on top of another to form a stack of blanks. Unfortunately, by the time the stack of blanks has reached the body fabrication facility and is ready to be utilized in the body manufacturing process, the lubricating film has often thickened or hardened and may tend to act as a bonding agent between adjacent blanks stacked on top of one another. This makes the task of separating individual blanks from the stack quite a difficult operation.

However, the high speed destacking of blanks is a critical aspect of the fabrication process if one wants to ensure continuous, productive operation of the body fabrication system.

In an example of a body fabrication process, the blanks are typically stored in a stack on a pallet and moved to a separation station by a forklift. At this station the pallet is placed on a lift device, such as a lift table, which then elevates the stack to present the top blank to a blank separation apparatus or destacker. A known separation device for steel blanks includes several components including an overhead, movable pick up device that employs vacuum suction cups which can be positioned above the stack. The suction cups can be lowered into engagement with and attach themselves to the upward facing surface of the top blank on the stack. For steel blanks, it is known to employ magnets which are disposed at the edges of at least the top two steel of the stack. The magnets, which may be permanent magnets or electromagnets, can create a magnetic charge in at least the top two steel blanks, causing these top two blanks in the stack to repel each other. The result is that there is fanning or separation of the edges of the sheets. This fanning permits any seal that has been created between the top two blanks to be broken, and it is possible for the overhead mounted pick-up device with suction cups to then pick up the top most blank and separate it from the rest of the stack of blanks. The blanks are then moved by the pick-up apparatus to a drop off position where the vacuum at the suction cups is removed. There the blank is dropped onto a conveyor which moves the individual blank to various body fabricating stations for processing.

The separation of individual blanks from the stack of blanks continues as each blank in turn is indexed into the proper position relative to the magnets until the stack is exhausted of blanks. This sort of blank separation apparatus is quite flexible for the handling of different shaped and sized blanks, multiple blanks and patterned blanks, as well as either tailor welded or laser welded blanks. Furthermore, this type of separation apparatus is capable of handling blanks of different thicknesses. However, this type of separation device, because it uses magnetic forces to assist in separating the blanks from each other, does not work with aluminium, or other materials which can not be charged magnetically.

Accordingly, it is particularly desirable to have an apparatus which can assist in separating blanks from a stack of blanks which can not be charged magnetically, for example a sack of aluminum blanks. At the same the it is desirable to have automated separation system which minimizes he number of reject blanks (ie. Blanks which can not be separated from the stack, as this help minimize costs.

SUMMARY OF INVENTION

An apparatus for separating a first blank from a stack of blanks comprising said first blank and a second blank positioned beneath of said first blank, said apparatus comprising: a nozzle assembly having at least one pressure nozzle; a source of pressurized fluid in communication with said at least one pressure nozzle to provide pressurized fluid to said nozzle; a pick up assembly having a pick up apparatus mounted thereon and operable to pick up said first blank when located proximate thereto; said nozzle assembly and said stack of blanks being movable relative to each other to bring said at least one pressure nozzle into a position proximate said stack of blanks and oriented so that said at least one nozzle can direct pressurized fluid at said side edge of said first blank; said pick up apparatus operable to be positioned proximate said first blank to pick up said first blank, said source of pressurized fluid supplying said at least one nozzle with pressurized fluid directed at the side edge of said first blank to assist said pick up apparatus in separating said first blank from said second blank; whereby said first blank can be separated from said second blank by said pick up apparatus assisted by pressurized fluid from said at least one nozzle.

An apparatus for separating a first blank from a stack of blanks comprising said first blank and a second blank positioned beneath said first blank, wherein said first and second blanks each have at least one edge, said edge of said first blank and said edge of said second blank being substantially aligned one above the other, said apparatus comprising: a pick up assembly having a pick up apparatus mounted thereon and operable to pick up said first blank when located proximate thereto, and said pick up apparatus further comprising an edge lifting device, operable to lift said edge of said first blank from said edge of said second blank; and said pick up apparatus operable to be positioned proximate said first blank to pick up said first blank once said edge lifting device has lifted said edge of said first blank from said edge of said second blank; whereby said first blank can be separated from said second blank by said pick up apparatus assisted by said edge lifting device.

A method of separating a blank from a stack of blanks comprising at least a first blank and a second blank positioned beneath said first blank using a pick up assembly, said method comprising the steps of: applying a force with said pick up assembly to said first blank so as to lift said first blank away from said second blank; forcing a fluid against a side edge of said first blank to assist said pick up assembly; and removing said first blank from said stack of blank A method of separating at least one blank from a stack of blanks comprising at least a first blank on top of a second blank comprising the steps of: applying a first force at an edge of said first blank in a direction away from said stack of blanks; applying a second force a distance from said edge of said first blank; and separating said first blank from said stack of blanks.

An apparatus for separating at least one blank from a stack of blanks comprising a first blank and a second blank positioned beneath said first blank, said apparatus comprising: a frame; an air nozzle assembly having at least one air pressure nozzle able to discharge air at pressures higher than ambient mounted to said frame; a first pickup apparats movably mounted to said frame operable to apply a first force at the edge of said first blank so as to separate said first blank from said second blank; a second pickup apparatus movably mounted to said frame operable to apply a second force to the interior of said first blank so as to assist said first pick up apparatus in separating said first blank from said second blank; said first and second pickup apparatuses positioned proximate the upward facing surface of said first blank and movable from a first position to engage said first blank of said stack and a second position a distance from the upper surface of said stack of blanks; and said air nozzle assembly positioned proximate to the edges of said blanks of said stack of blanks and said air nozzle assembly and said stack of blanks being movable relative to each other and said air nozzle assembly positioned to assist in the separation of said first blank from said blank by directing pressurized air at the edge of said first blank whereby said edge of said first blank is separated from said second blank prior to said interior of said first blank being separated from the interior of said second blank.

An apparatus for separating a first blank from a stack of blanks comprising said first blank and a second blank positioned beneath of said first blank, said apparatus comprising: means to direct a pressurized fluid; a source of pressurized fluid in communication with said means to direct said pressurized fluid; a pick up means for picking up said first blank when said first blank is located proximate thereto; said means to direct said pressurized fluid positioned to direct pressurized fluid at said side edges of said first blank and said second blank; said pick up means operable to be positioned proximate said first blank to pick up said first blank, said source of pressurized fluid supplying said means to direct pressurized fluid with pressurized fluid which is directed at the side edges of said first and second blanks to assist said pick up apparatus in separating said first blank from said second blank; whereby said first blank can be separated from said second blank by said pick up means assisted by pressurized fluid emitted from said means for directing pressurized fluid.

An apparatus for separating a first blank from a stack of blanks comprising said first blank and a second blank positioned beneath said first blank, wherein said first and second blanks each have at least one edge, said edge of said first blank and said edge of said second blank being substantially aligned one above the other, said apparatus comprising: a pick up means for picking up said first blank when said first blank is located proximate thereto, and said pick up means further comprising an edge lifting means, operable to lift said edge of said first blank from said edge of said second blank; said pick up means operable to be positioned proximate said first blank to pick up said first blank once said edge lifting device has lifted said edge of said first blank from said edge of said second blank; whereby said first blank can be separated from said second blank by said pick up apparatus assisted by said edge lifting device.

Aspects of the invention are adapted to direct pressurized fluid (e.g., air) at the edges of a first and a second blank so as to separate the first blank from the second blank. The pressurized air may be directed from two separate nozzles, each nozzle directing pressurized fluid at differing pressures. A first nozzle, which may be oriented to direct pressurized fluid in a downward direction, may direct pressurzed fluid at a relatively high pressure (e.g., about 60–160 p.s.i.) while a second nozzle, which may be oriented to direct pressurized fluid in an upward direction, may direct fluid at a relatively low pressure (e.g., about 40–120 p.s.i.). The first and second nozzle may operate for different periods of time. The time of operation of the first nozzle may overlap with the time of operation of the second nozzle. The first nozzle may be adapted to assist in the initial separation of the first blank form the second blank. The second nozzle may be adapted to further separate the first blank from the second blank.

DETAILED DESCRIPTION OF THE PREFERRED EMBODIMENT

Figure 1:
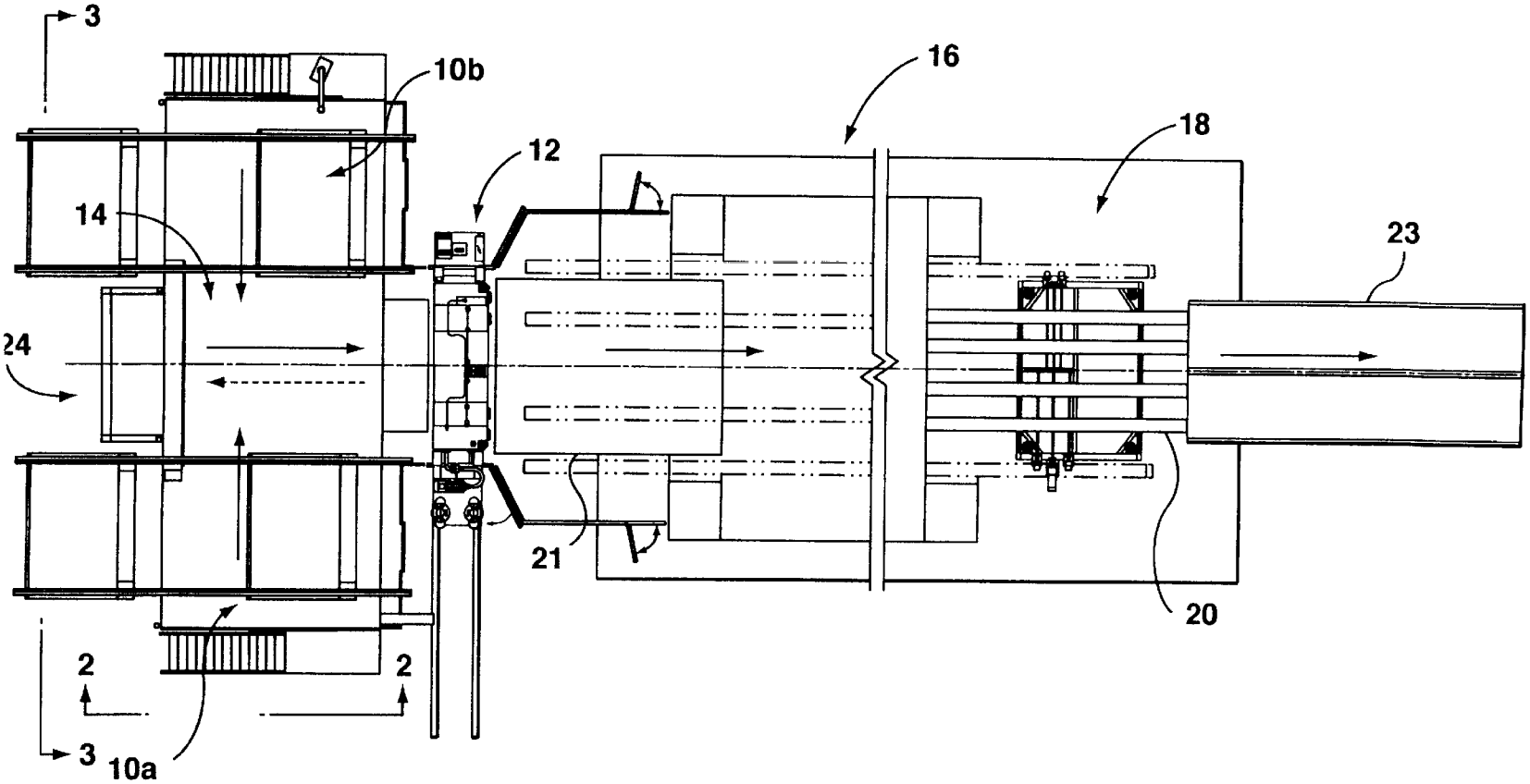
FIG. 1 is a top plan schematic view of an example of a system employing the preferred embodiment of the present invention.

With reference to FIG. 1, a body panel manufacturing system comprises several component stations and components including blank separation or destacking stations generally designated 10*a* and 10*b*, a blank conveyor 14, a blank washing station 12, blank processing stations collectively designated 16, a body panel transfer station 18, and an exit conveyor 20. Blanks 22 arrive on a pallet at separation station 10*a*, 10*b*. Blanks 22 may be made of steel, aluminium, or other materials including paper products and plastic products.

The separation apparatus separates a blank 22*a* from the stack of blanks 22 and transfers blank 22*a* to a conveyor 14. It will be noted that in this arrangement, there are actually two destacking or separation stations 10*a* and 10*b*, one disposed on either side of, and both feeding, the conveyor 14. This permits some flexibility in the operation of each of the separation stations 10*a* and 10*b*, while still providing a continuous flow of blanks to conveyor 14.

In one embodiment, once a separation apparatus has delivered a blank 22 to the conveyor 14, sensors located on the pick up assembly (not shown) detect whether or not the separation apparatus was successful in delivering a single blank to the conveyor or whether more than one blank was actually picked up and transferred to the conveyor. In the preferred embodiment, however, the sensors 61 (such as for example eddy current such as ultra sonic or magnetic flux sensors located on the pick apparatus of a type which would be known to persons skilled in the art), will detect whether more than one blank has been picked up. If so, the PLC 42*a*,42*b* will instract the system to make repeated attempts to separate the blanks, as described hereinafter in more detail. This repeated action will reduce the number of blanks requiring other handling measures (eg. Such as human intervention).

Conveyor 14 is configured such that if two or more blanks 22 were actually picked up during the separation process and deposited on conveyor 14, then the conveyor 14 will reverse its direction (as shown in the dotted line in FIG. 1) to discard the two or more blanks to a discard station 24.

As mentioned above, and it should be appreciated that, in the following description of separation station 10*a*, that the separation station 10*b* is identically constructed and is arranged to work in conjunction with separation station 10*a* to continuously supply conveyor 14 with single blanks. Conveyor 14 then delivers each blank 22 through washing station 12 and then to a load table 21 which transfers each blank 22 in turn to process stations 16. Once processed, the fabricated body 23 is then placed onto an exit conveyor 20 and exits the body fabrication system.

Figure 2:
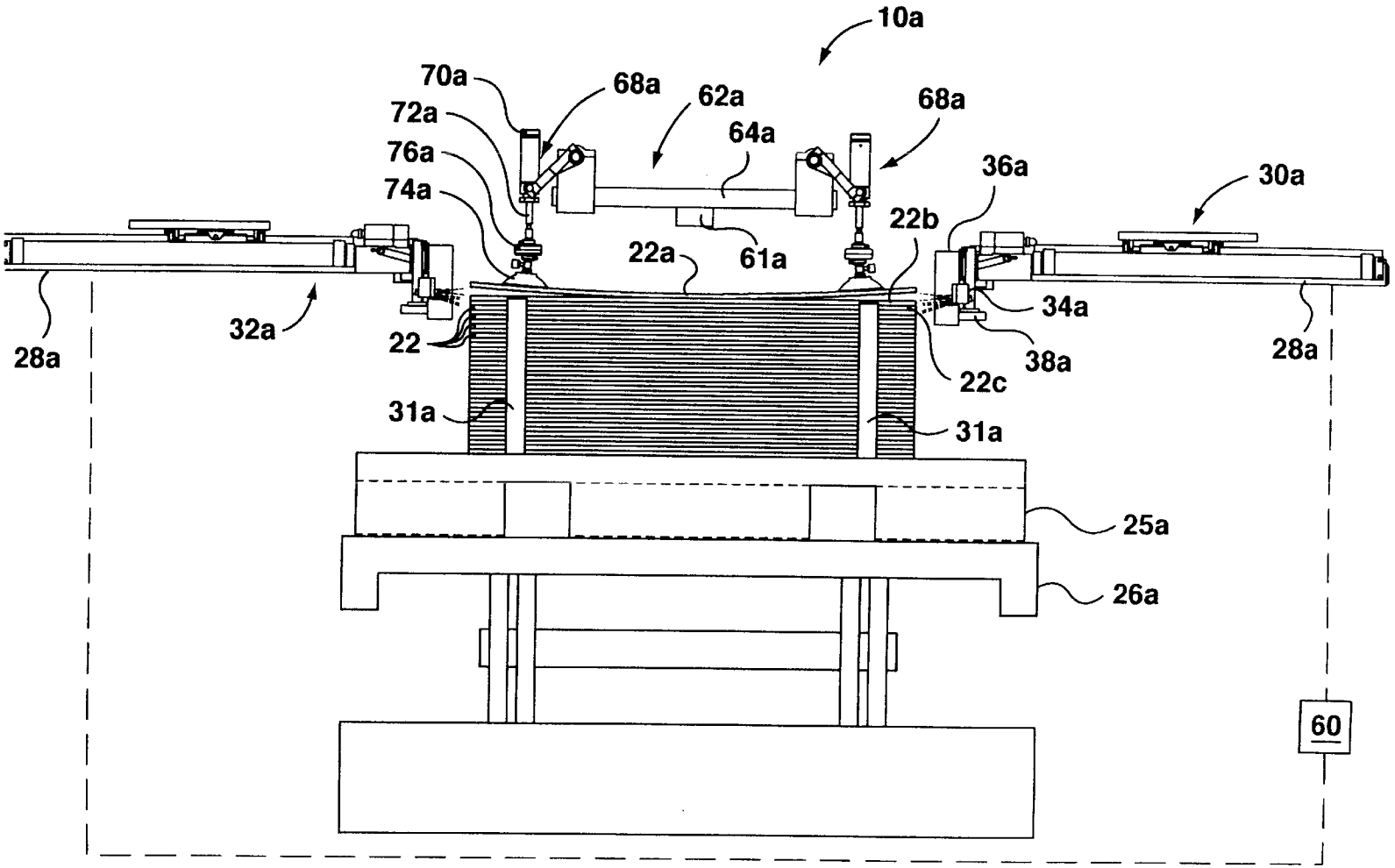
FIG. 2 is a side elevation view at 2—2 in FIG. 1.
Figure 3:
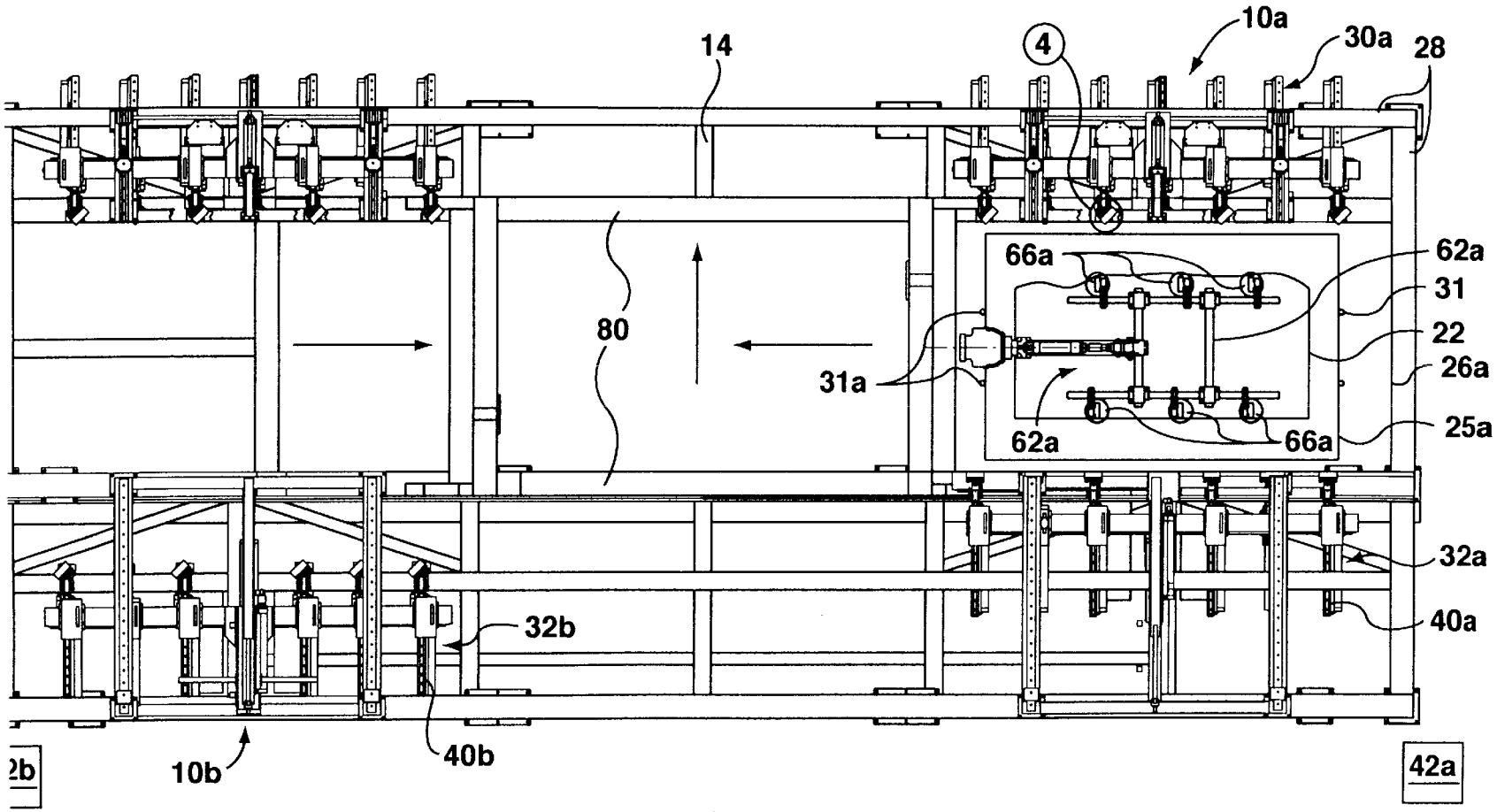
FIG. 3 is an elevation view at 3—3 in FIG. 1.
Figure 3A:
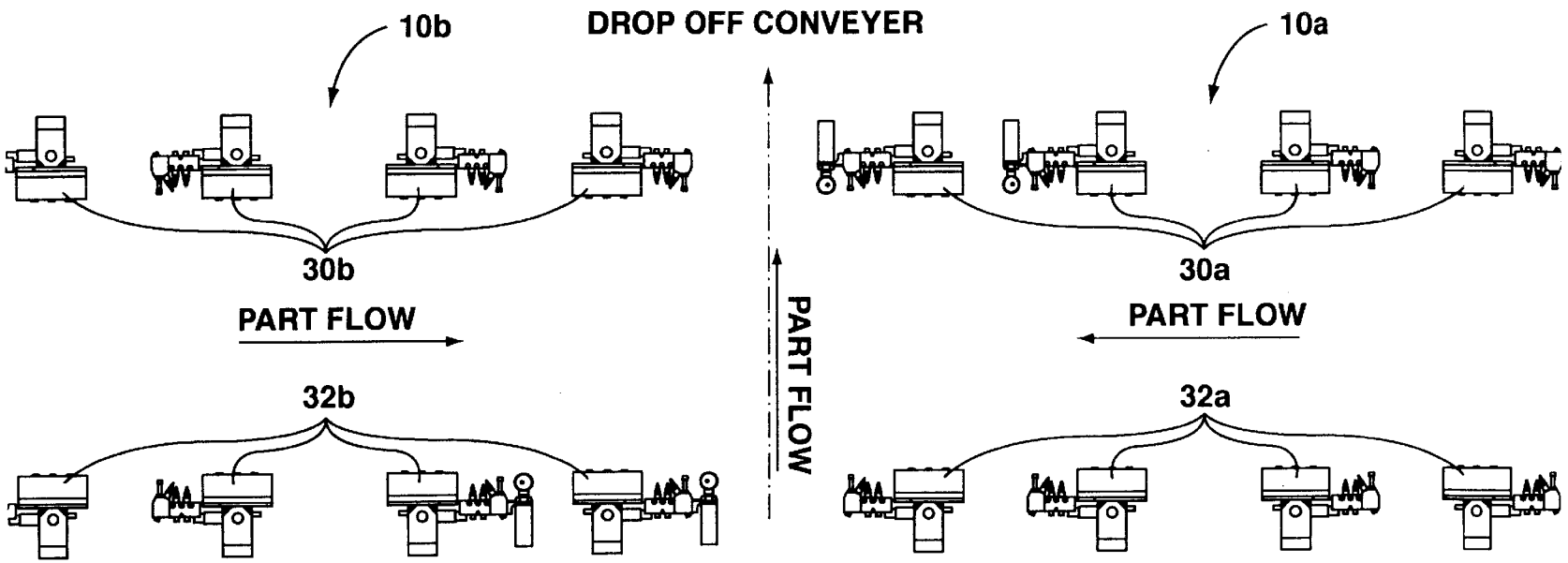
FIG. 3*a* is a schematic plan view of components of the preferred embodiment.

The separation station 10*a* is shown in detail in FIGS. 2 and 3, and is representative of separation 10*b* as well. As shown in FIGS. 2 and 3, a lift table 26*a* is positioned beneath a frame structure 28*a* which supports a first bank of separation devices 30*a* and another opposite facing bank of separation devices 32*a*, each bank of separation devices of both separation stations 10*a* and 10*b* being shown schematically in FIG. 3*a*. It should be noted that lift table 26*a* is loaded with a pallet 25 of blanks at a position remote from frame structure 28*a*, and then by way of program control, such as by way of a PLC 42*a* and with the assistance of sensors and detectors (not shown) the table is moved on rollers along a track into position beneath frame structure 28*a*. Pallet 25 has vertically oriented blank guide pins at both ends that keep the blanks in longitudinal alignment.

Each of separation devices 30*a*,32*a* comprises a nozzle way or assembly generally designated 34*a*, a magnet assembly 36*a* and an alignment mechanism 38*a*, all mounted to a shaft 40 which is secured to frame 28. Nozzle array 34*a*, alignment mechanism 38*a* and magnet assembly 36*a* all are mounted for pivoting movement about bearing 51*a* to permit them all to rotate together. This allows for the separation device 30*a*,32*a* to pivot to flush itself in relation to the edge of a blank of a non-rectangular blank. The nozzle array 34*a*, and the alignment mechanism 38*a* are mounted to shaft 42*a* by way of an arm 52*a*. It should be noted that for separation devices 32*a*, 32*b*, shafts 40*a*, 40*b* can reciprocate between extended and retracted positions. In FIG. 3 the separation devices 32*b* are shown in a retracted position and the separation devices 32*a* are shown in the extended position. The ability to retract and extend each of the separation devices is accomplished by mounting the shafts 40*a*, 40*b* of the separation devices 32*a*, 32*b* on the piston of a reciprocating pneumatic cylinder which can be actuated by programmable controller 42*a*, 42*b*.

Magnet assemblies 36*a* are constructed in a known manner and comprise a magnet 44*a* which may either be an electromagnet or a permanent magnet. If the blanks are made of steel or other material which can be charged magnetically, then when an edge of top blanks 22*a* and 22*b* are brought into the vicinity of magnet 36*a*, magnet 36*a* charges both of the top two adjacent sheets with the same polarity with the result that both of the sheet's edges will repel each other causing the edges of the sheets to separate and fan.

Figure 4:
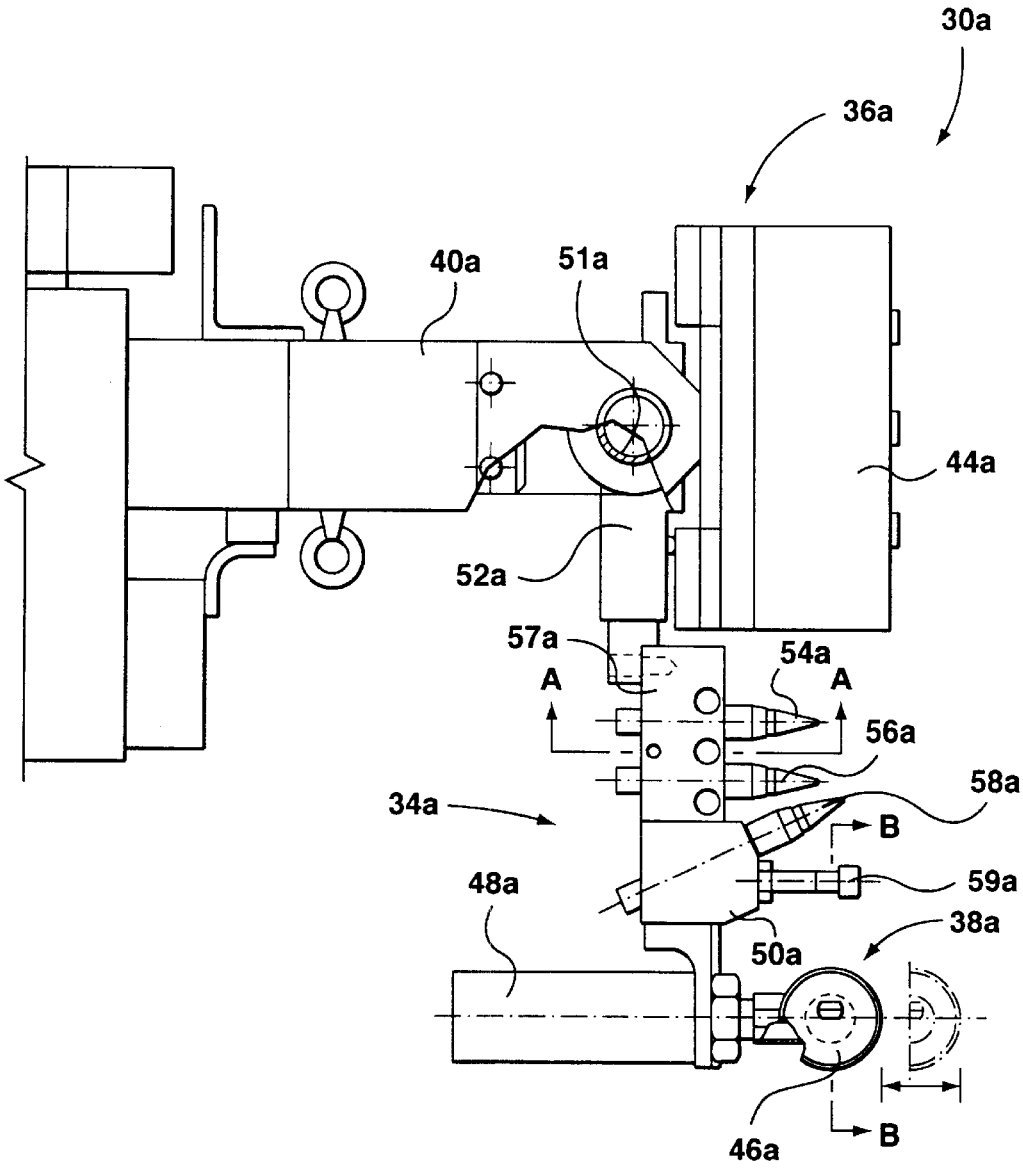
FIG. 4 is a top plan view of representative part 4 in FIG. 3.

Each separation assembly 30*a*,32*a* also comprises an alignment mechanism 38*a* which includes a reciprocating roller 46*a* (shown in retracted position in solid line in FIG. 4 and in an extended position in broken line) which is mounted to the piston of a pneumatic cylinder 48 which can also be controlled and actuated by PLC 42*b*. Each of rollers 46 on the separation devices 30*a*, 32*a* working in co-operation with the blank guide pins 31*a* to align and straighten blanks which become mis-aligned during the separation process, by actuating rollers from both banks 30*a* and 32*a*, pushing blanks adjacent to the rollers 46*a* together. This provides for the proper orientation of the blanks 22 for future separation.

Also mounted from arm 52*a* is nozzle array 34*a* which comprises nozzles 54*a*, 56*a* and 58*a*. Although not shown, each nozzle is connected by hoses to a source of pressurized air, namely compressor 60. In one embodiment there is one a valve disposed between compressor 60 and each of high pressure nozzles 54*a*, 56*a*, controlled by plc 42*a* and another valve disposed between compressor 60 and each of the low pressure nozzles 58*a*, also controlled by the plc. It is however possible to provide a valve associated with each of the nozzles, thus providing greater flexibility in the control and activation of the nozzles. This would allow for efficient use of the compressed air. It should be noted that depending upon the particular fabrication environment and the material from which the blanks are made, another a treated air, another gas or mixed gas, or even a suitable fluid might be provided to the nozzle, such as treated air, including dried air (particularly self with paper products) and ionized or deionized air.

Figure 5:
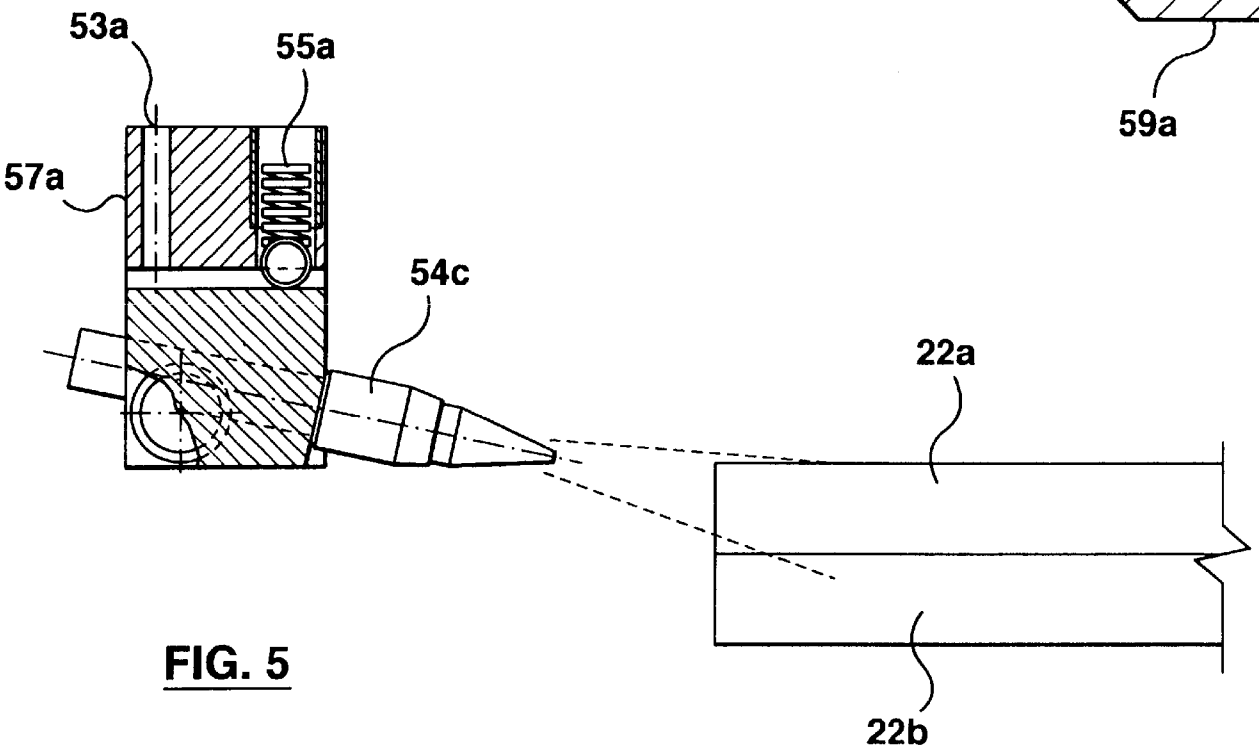
FIG. 5 is a cross sectional view at A—A in FIG. 4.

Nozzles 54*a* and 56*a* are swivel mounted high pressure nozzles such as the high thrust nozzles model 1205/910 manufactured by ITW Vortec and the air pressure at the nozzle outlets will in the preferred embodiment be can range between 160 psi and 60 psi. FIG. 5 shows by way of example, the swivel mounting of nozzle 54*a* in a flanged bearing arm extension 57. Each of nozzles 54*a* and 56*a* can have its vertical orientation altered by way of a set screw 53*a* being adjusted. Set screw 53*a* merely hold nozzles 54*a*,56*a* in position in the mounting. The nozzle position will be adjusted so that when the top two blanks 22 and 22*b* are positioned adjacent the nozzle, high pressure air will be expelled against the edges of the top blank and will cause the edges to ripple. The PLC 42*a* (FIG. 3) will control the supply of high pressure air to the nozzles 54*a*, 56*a*, which in the preferred embodiment may only be applied to the edges of the blanks for a period as short as 0.25 seconds. The position of the nozzles 54*a*,56*a* is adjustable so that different thicknesses of blanks can be accommodated (et., the nozzles can be moved to direct the pressurized air at the desired position.

Figure 6:
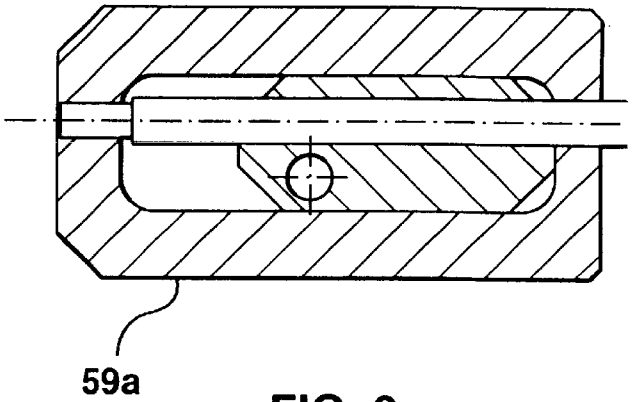
FIG. 6 is a cross sectional veiw at B—B in FIG. 4.

In FIG. 6, the set screw assembly for low pressure nozzle 58*a* is shown in cross section. The set screw 59*a* acts simply to hold nozzle 58*a* in place.

In the preferred embodiment, high pressure nozzles 54*a* which is inclined slightly downward onto the edge of blank 22*a*, and when activated by plc 42*a* emits a burst of high pressure air substantially against the side edge of the blank, but with possibly some spill over air passing over the upward facing surface of the blank. This tends to cause a flexure in the top blank 22*a*, creating a transient gap. Additionally, second high pressure nozzles 56*a* is oriented vertically upward at a small inclination and when activated by plc 42*a* tends to further push the blank upward and opening the gap created by the first nozzle. Finally, the low pressure nozzles, 58*a* controlled by plc 42*a* emits relatively lower pressure burst of air to more deeply penetrate into the inner areas of the blank, opening the gap further.

Some of the benefits of creating the air gap and thus assisting in breaking the seal between blanks 22*a* and 22*b* can be achieved by using one or two nozzles to direct air against the side of the top blank 22*a*. However, the flexibility that comes with multiple nozzles, is effective in separating blanks which are toward the bottom of the stack of blanks 22. Also, it should be noted, air nozzles preferably have a cylindrical nozzle opening but other nozzles and nozzle openings can be utilized, such as air knives.

Nozzle 58*a* is a fixed nozzle and emits a relatively lower air pressure (preferably approximately 60 psi, but may be in the range of 40 psi to 120 psi and, if desired, may be operated as a high pressure nozzle similar to nozzles 54) but is applied to the blanks for a longer period of time (preferably in the order of 1 sec). The air pressure from nozzle 58*a* is not directed so much at the edges of the blanks, but rather is directed between the blanks, once the edges of the blanks have started to peel away from each other, nozzle 58*a* emits air to increase penetration toward the centre of the blanks.

Referencing FIGS. 1, 2, 3, and 4, a pallet containing a stack of blanks 22 is movable on the lift table 26*a* underneath one of the banks of separation devices 30*a*, 32*a*. The lift table 26*a*, being controlled by PLC 42*a*, lifts the stack of blanks 22 up to the banks of separation devices 30*a*, 32*b*. The top blanks 22*a*,22*b* are moved up so that they are properly in alignment with each of the separation devices 30*a*, 32*a*.

The pick up assembly/apparatus 62*a* (note pick up assembly 62*b* is not shown) comprises a frame 64 and a plurality of suction cup assemblies 66*a* and 68*a*. Pick up apparatus 62*a* is movable along a support between a drop off position proximate and above blank conveyor 14, and a blank pick up position between separation apparatus 30*a*,32*a*. A vacuum is created at each of the suction cups 66*a*, 68*a* by conventional means. Suction cup assemblies 66*a* are substantially fixedly mounted in relation to frame 62 and located in a position such that when at the separation position, they are medially positioned, or positioned proximate the interior portion of the blanks 22, and away from the side edges of he blanks. Suction cup assemblies 68*a* are mounted to frame 64*a* preferably disposed to be in vertical alignment of a corner region or side edge region of the blank. Thus, for rectangular blanks, there could be one such suction cup assembly 68*a* mounted approximate each of the 4 corners. In the preferred embodiment a total of twelve suction cup assemblies 66*a*, 68*a* are mounted to frame 64*a*. However, for the purposes of simplicity only six such suction cups 66*a* are shown in FIG. 3. The number of suction cups and the amount of suction force exerted by each cup on the surface of a blank 22, that will required to lift a blank 22 depends upon size and thickness of the blank, and the material from which it is made, as well as the bonding encountered between adjacent blanks.

As will be evident from the description that follows, each of suction cup assemblies 68 is mounted for vertical movement relative to frame 64*a* by means of pneumatic cylinder 70*a*. The shaft of the suction cup assembly 68*a* (shaft 72*a*) is attached to a piston of chiders 70*a*. By actuation of pneumatic cylinder 70*a*, shaft 72*a* of suction cup assembly 68*a* can move up and down to alter the vertical position of suction cup 74. The actuation of the cylinders on each of the suction cup assemblies 68*a* is also controlled by PLC 42*a*.

Figure 7:
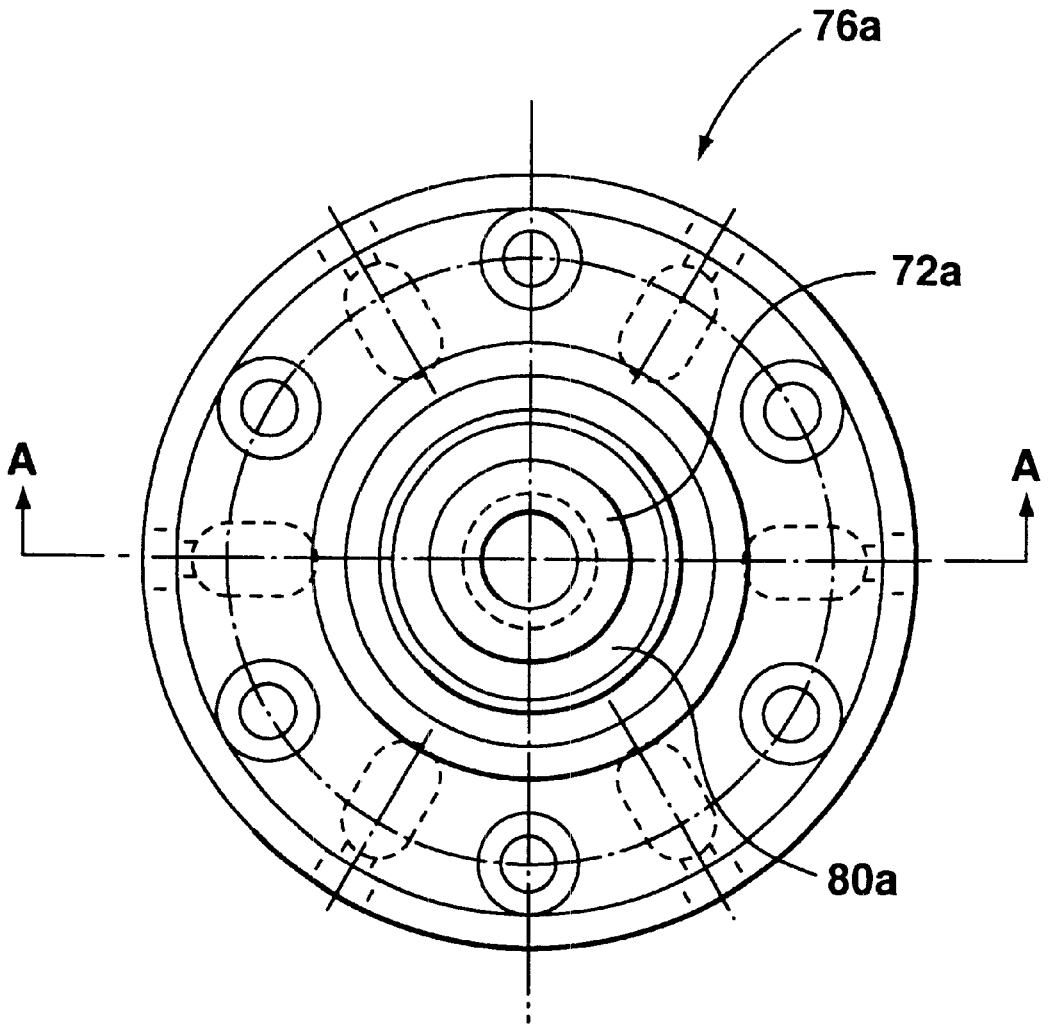
FIG. 7 is a top view of part 7 in FIG. 2.
Figure 8:
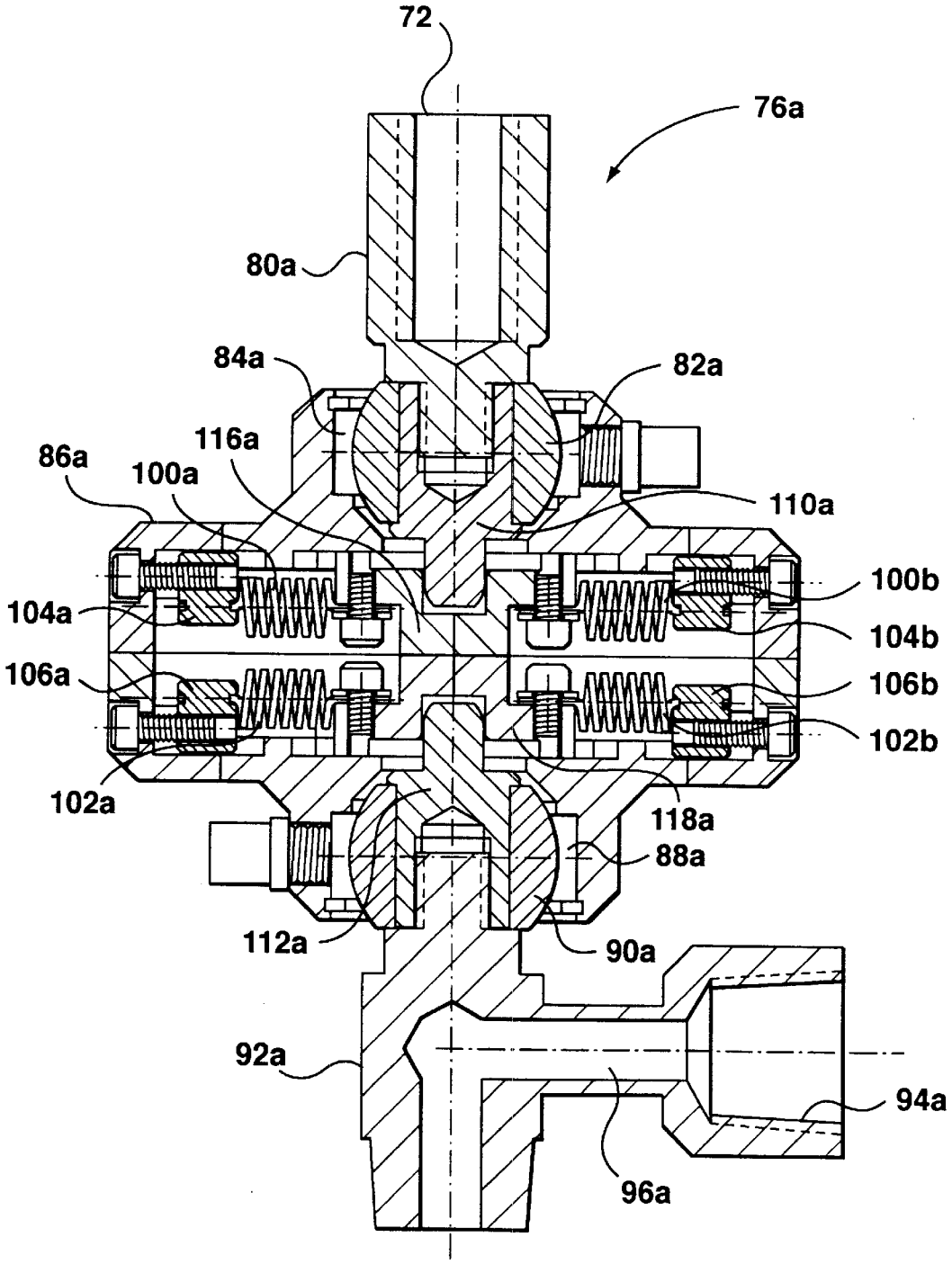
FIG. 8 is a sectional view at A—A in FIG. 7.

Suction cup 74*a* is mounted to shaft 72*a* by means of a coupling assembly 76*a* shown in detail in FIGS. 7 and 8. Coupling assembly 76*a* permits the suction cup to rotate in two degrees of freedom. Refining FIGS. 7 and 8, coupling assembly 76*a* is shown in plan view and in front elevation, respectively. Disposed within a cavity formed by shaft housing 80*a* is shaft 72*a*. Proximate upper terminating stub 10*a* of shaft housing 80*a* is fixed upper annular ball 82*a* which slidably fits within an upper socket cavity 84*a* formed within coupling housing 86 thus forming a ball and socket joint. Coupling housing 86*a* also has a lower socket cavity 88 slidably fitted into which is lower annular ball 90*a*. Lower annular ball 90*a* is fixedly attached proximate to lower terminating stub 112*a* of suction cup housing 92*a* which terminates at the other end with a suction cup (not shown) mounted thereto. Suction cup housing 92*a* incorporates conduit 96*a* communicating pressure hose receptacle 94*a* with a suction cup (not shown in FIGS. 7 or 8).

Within coupling housing 86*a* are upper springs 100A, 100B and lower springs 102A, 2103. Upper springs 100A, 100B are mounted at one end to adjustable mounting devices 104A, 104B, respectively. Similarly, lower springs 102A, 1028B are mounted at one end to adjustable mounting devices 106A and 106B, respectively. Adjustable mounting devices 104A, 104B, 106A and 106B allow for the tension in the initial or free position (that is, when no outside forces are acting on coupling assembly 76*a*) of upper and lower springs 100 and 102 to be adjusted. Mounted on one side of upper centering block 116*a* is the other end of upper spring 104A and mounted on the other side of upper centering block 116*a* is the other end of upper spring 104B. Centering block 116*a* is suitably mounted within coupling housing 86 and has a recess into which upper terminating stub 110*a* of shaft housing 80*a* is disposed. Similarly, mounted to either side of lower centering block 118*a* is the other ends of lower springs 106A and 106B. Lower centering block 118 is also slidably mounted within coupling housing 86*a* and forms a recess in which lower terminating stub 112*a* of suction cup housing 92*a* is disposed.

A rotation of shaft housing 80*a* relative to coupling housing 86, which may be caused by the application of the suction cup 74*a* being forced against a non-horizontal portion of a blank 22*a* (see FIG. 2), causes upper terminating stub 110*a* to impart a force on and slides centering block 110 relative to coupling housing 86*a*. The sliding of centering block 110*a* imparts a compressive force on one upper spring 100*a* and a tensive force on the other upper spring 100*a*. Upon the release of the blank by the suction cup, the energy stored within the compressed and tensioned springs 100*a* will cooperate to impart a force centering block 116*a* within coupling housing 86*a* which in turn forces upper terminating stub 110*a* (and the entire shaft housing 80*a*) to be centered relative to coupling housing 86 (i.e. housings 80*a* and 86*a* will be returned to their initial relative positions).

In a similar fashion a force causing the rotation of suction cup housing 92*a* relative to coupling housing 86*a* will impart tensive and compressive forces on lower springs 102*a* caused by the sliding of lower centering block 118*a* within coupling housing 86 due to a force imparted on lower center block 118*a* by lower terminating stub 112*a*. Upon the removal of the rotational force, suction cup housing 92*a* will be centered, that is returned to its initial position, relative to coupling housing 86 by centering block 118*a* acting upon lower terminating stub 112*a* of suction cup housing 92*a* by the release of the energy store in the compressed and tensioned lower springs 102.

Coupling assembly 76 provides two degrees of freedom to suction cup assembly 68*a* with approximately 6 degrees of angular rotation and some amount of lateral displacement of suction 74 relative to shaft 72.

In operation, a pallet containing blanks 22*a* is moved into position on lift table 26*a* then lift table 26*a* is moved into position beneath the banks of separation devices 30*a*, 32*a*. Pick up apparatus 62 is moved into position above the stack of blanks. Table 26*a* is elevated to a position where the top blank 22*a* and te next blank down 22*b* have adjacent faces aligned as described earlier with the opening in each of the high pressure nozzles 54*a*, 56*a*. This indexing of blanks 22*a* and 22*b* into position is accomplished by use of electronic sensors and detectors (not shown) which are controlled by PLC 42*a*. Pick up assembly 62*a* moves vertically downward so that suction cups or assemblies 66*a* and 68*a* are positioned proximate the top surface of blank 22*a*. The suction cup 74*a* of suction cup assembly 68*a* are it an extended position having been activated by pneumatic cylinder 70*a* such that all suction cups of assemblies 66*a* and 68*a* contact the upper surface of blank 22*a* at approximately the same time.

The nozzle openings and the face of the magnets 44 of each of separation devices 32*a* are also brought into position approximately blanks 22*a* and 22*b* by extending shafts 40*a*. If blanks 22*a* and 22*b* are made of steel or another metal which can be charged magnetically, then the magnets are energized (if electromagnets). With the magnets energized, the edges of the blanks 22*a* and 22*b* adjacent the magnets repel each other with the result that any bond existing between the blanks, at least at the edge regions of the blank, tends to be broken. In conjunction with the action of the magnets upon the blanks, the pneumatic cylinders 70 of suction cup assemblies 68 retract pistons 72 thus creating a lift force at the corner or edge areas of blank 22*a*. A bending of the edges upwards may be enhanced by the resultant downward force exerted by suction cup assemblies 66*a* in medial portions of the blank 22*a*. This upward movement of suction cups 74*a* tends to cause the corners of blanks 22*a* to peel up and away from the upper surface of blank 22*b*. Once the peeling up of the corners/edges has commenced, the pick up apparatus 62*a* will as a whole start to rise vertically, and the suction cup assemblies 66*a* will assist suction cup assemblies 68*a* in lifting the blank 22*a* to complete the separation.

The separation of blank 22*a* from 22*b* can also be assisted by the application of pressurized air through nozzle arrays 34*a*. The use of the pressurized air may be essential to separate blanks which can not be magnetically charged, such as with aluminium blanks. Even with blanks that can be magnetically charged, the use of the pressurized air greatly assists in the task of separating blanks.

In those situations where pressured air is used, nozzles 54*a*, 56*a* direct high pressure air at the middle of side edges of blank 22*a*, 22*b*, respectively. The bursts of high pressure air, on each of the side edges of blanks 22*a* and 22*b* cause the edges of thee blanks to ripple and will penetrate to some extent between the blanks. This action is enough to allow the suction assemblies 69*a* to peel slightly upward the corners or edges of blank 22*a* away from blank 22*b*. High pressure nozzles 54*a*, 56*a* are assisted in this initial time period by the application of lower pressure air from nozzles 58*a*.

Once a gap between the two adjacent blanks has been established at their edges, relatively low pressure from nozzles 58*a* is continued to be applied into the gap(s) between blanks 22*a* and 22*b* which may create an air cushion between blanks 22*a* and 22*b*. As this burst is for a relatively longer period of time, it will have a relatively large degree of penetration between the blanks and assist in breaking any residual bonding between blank 22*a* and blank 22*b*. Thus, the combination of the retractable suction cup assemblies 68*a* and the pressurized air between the two blanks 22*a* and 22*b* assists the pick up assembly 62*a* with suction cups 66*a* to lift and separate blank 22*a* from blank 22*b*. The nozzle set up and air burst sequence the same when the pressurized air is being used to supplement the action of the magnets.

Once the seal has been broken and blank 22*a* has been successfully removed from the stack of blanks 22, the pick up assembly 62*a* will move along rails 80 towards conveyor 14 where the vacuum is removed and the blank 22*a* will be dropped onto conveyor 14 to be taken for further processing. Thereafter, the pick up assembly 62*a* will return towards the stack of blanks to retrieve the next blank 22*b*. Depending upon the particular application, the pick up apparatus may perform between fifteen and eighteen cycles per minute. While pick up assembly is moving blank 22*a* towards conveyor 14, the lift table 26*a*, monitored by sensors, and controlled by PLC 42*a* is elevated to re-index the next two blanks, 22*b* and 22*c* into position such that blank 22*b* can be separated by 22*c* by the same process described for separating blank 22*a* from blank 226. This sequence will continue as station 10*a* congiuously supplies individual blanks 22 to conveyor 14.

Figure 9:
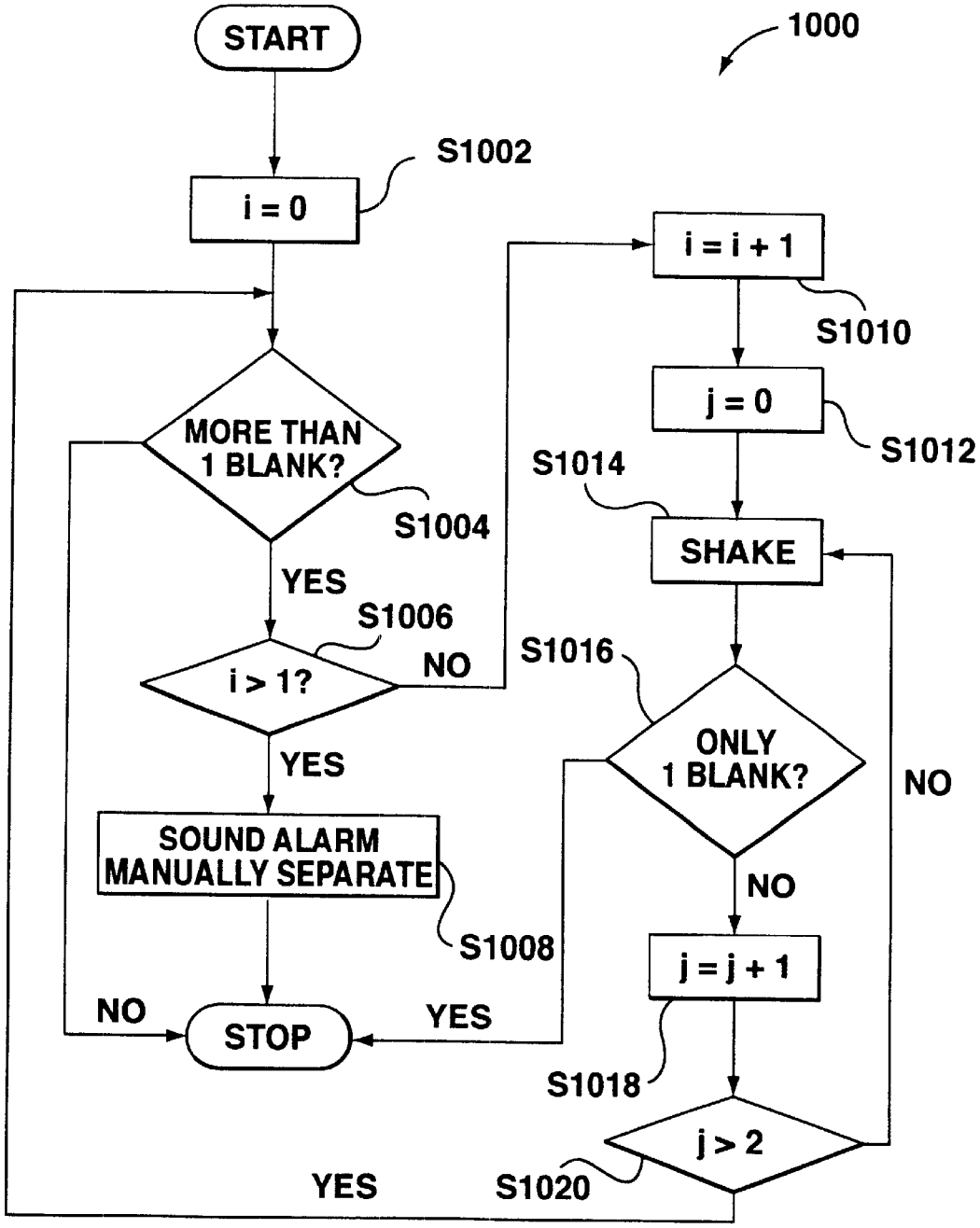
FIG. 9 is flow chart of one operation of the preferred embodiment.
Figure 10:
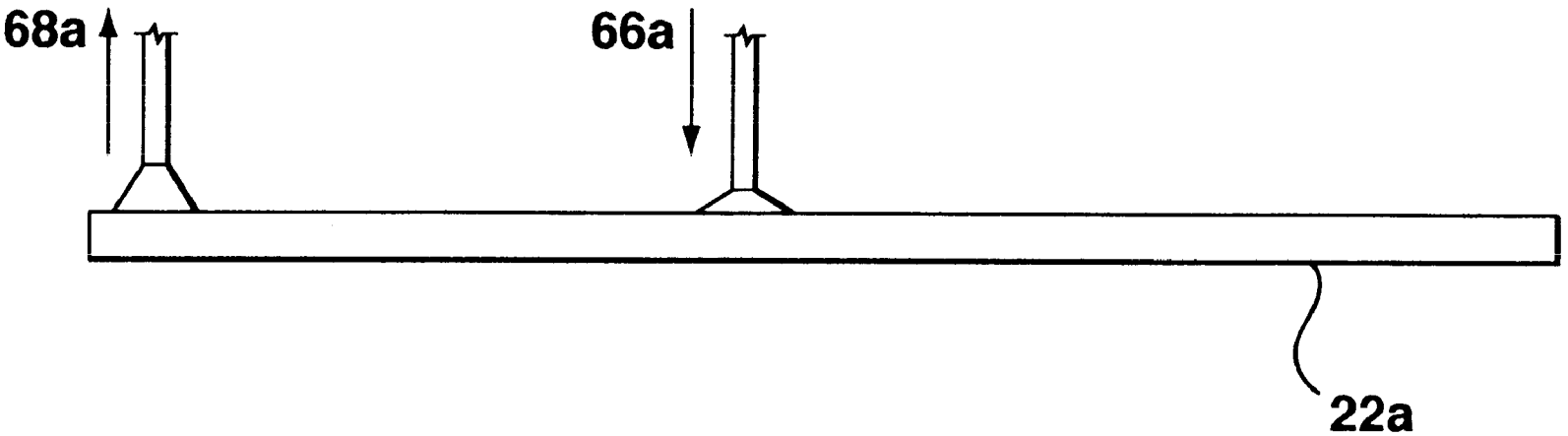
FIG. 10 is a side of a portion of the preferred embodiment.

As mentioned above, sensors 61*a* will detect whether or not more than blank 22*a* has been picked up. If more than one blank has been picked up, the pick up apparats will not move the blanks it is crying to conveyor 14, but will maintain those blanks above the stack and commence a series of operations 1000 of FIG. 9 to minimize such occurrences. PLC 42*a* sets an internal counter (i) to zero in step S1002. If there is more than one blank 22 picked up by pickup apparatus 62*a* (S1004) and the counter is less than one (i.e. the attempts at further separation have not been attempted more than twice) (S1006), the counter will be increased (S1010) and a second internal counter (j) will be initialized (S1012). The pickup apparatus 62*a* will commence series of up and down vertical movements to, in effect, try to shake the other blanks from blank 22*a* (S1014). This action will be assisted by the activation of the nozzles to supply pressurized air against the side edges of the blanks in a manner as described above. If this action is unsuccessful (S1016), the shaking operations will be commenced twice more (S1018, S1020) otherwise operations 1000 will cease. If the shaking operation (S1014) is unsuccessful three times (j>2, S1020) in separating blank 22*a* from the other attached blanks, pickup apparatus 62*a* will re-deposit the blanks on the stack, and then commence the whole procedure (S1004) once more. If, however, the shaking and redeposition of blank 22*a* with the attached blanks 22 is unsuccessful after this subsequent attempt, an alarm will sound and the blanks will be manually separated (S1008).

It will be appreciated that by providing for two separation stations, 10*a* and 10*b*, they may act in co-operation to continuously deliver blanks to conveyor 14 thus improving the amount of time it takes to deliver a blank to conveyor 14, and provide for greater flexibility (eg. if one of the separation stations malfunctions, the other station can continue to supply blanks to conveyor 14).

Many variations of the invention will be apparent to those skilled in the art within the scope of the appended claims once the principles are understood.

What is claimed is:

1. An apparatus for separating a first blank from a stack of blanks comprising said first blank and a second blank positioned beneath of said first blank, said first blank and said second blank each having a side edge, said apparatus comprising:

a first pressure nozzle for providing a pressurized fluid at a first pressure and a second pressure nozzle for providing pressurized fluid at a second pressure that is less than said first pressure;

a first source of pressurized fluid in communication with said first pressure nozzle and providing pressurized fluid to said first nozzle to be emitted at said first pressure and a second source of pressurized fluid in communication with said second pressure nozzle and providing pressurized fluid to said second nozzle to be emitted at said second pressure, said first and second pressures being greater than ambient pressure;

a pick up assembly having a pick up apparatus mounted thereon and operable to pick up said first blank when located proximate thereto;

said first and second pressure nozzles and said stack of blanks being movable relative to each other to bring said first and second pressure nozzles into a position proximate said stack of blanks and oriented so that said first pressure nozzle can direct pressurized fluid at said side edge of said first blank, said first pressure nozzle further adapted to direct said pressurized fluid at said side edge of said first blank at said first pressure and said second pressure nozzle further adapted to direct said pressurized fluid toward said first and second side edges of said first and second blanks at said second pressure;

said pick up assembly operable to be positioned proximate said first blank to pick up said first blank, said first pressure nozzle operable to direct said pressurized fluid at said side edge of said first blank at said first pressure and said second pressure nozzle operable to direct said pressurized fluid at said second pressure to assist said pick up apparatus in separating said first blank from said second blank;

whereby said first blank can be separated from said second blank by said pick up assembly assisted by pressurized fluid from said first and second nozzles.

2. An apparatus as claimed in claim 1 wherein said fluid is comprised of at least one pressurized gas.

3. An apparatus as claimed in claim 1 wherein said first pressure nozzle directs air at an edge of said first blank proximate said first pressure nozzle to cause the side edge of said first blank to flex, thereby creating at least a partial gap between said first blank and said second blank.

4. An apparatus as claimed in claim 1 wherein said first nozzle comprises a first pressurized air nozzle emitting air at said first pressure and said second nozzle comprises a second pressurized air nozzle emitting air at said second pressure.

5. An apparatus as claimed in claim 4 wherein said second air pressure is less than said first air pressure, and said first air pressure nozzle emitting pressurized air to cause the side edge of said first blank to flex and said second air pressure nozzle directing pressurized air into the gap between said first and second blanks to penetrate the gap between said first and second blanks, whereby said first blank may be more easily separated by sad pick up apparatus from said second blank.

6. An apparatus as claimed in claim 1 wherein said first and second blanks each have at least one edge, said edge of said first blank and said edge of said second blanks being substantially aligned one above the other, and wherein said pick up apparatus further comprises an edge lifting device, operable to lift said edge of said first blank from said edge of said second blank.

7. An apparatus as claimed in claim 6 wherein said pick up apparatus firer comprises a frame, said edge lifting device comprising a vacuum suction cup mounted to said frame, said vacuum suction cup being movable relative to said frame from a first position remote from a corner of said first blank, to a second position which engages an upward facing surface of said first blank proximate said edge of said first blank to grip said first blank proximate said edge, to a third position whereby said corner of said first blank is lifted away from said edge of said second blank.

8. An apparatus as claimed in claim 7 wherein said first blank has an upward facing surface, and said pick up apparatus also comprises a load applicator for applying a force tending to push said first blank against said second blank at an interior portion of the upward facing surface of said first blank remote from said edge of said first blank, thereby assisting in the peeling of said edge by said edge lifting device.

9. An apparatus as claimed in claim 6 wherein said pick up apparatus further comprises a frame and said edge lifting device comprises a first vacuum suction cup mounted on a reciprocating cylinder, and said cylinder is mounted to said frame, said first vacuum suction cup being movable by said reciprocating cylinder from a first position remote from said edge of said first blank, to a second position which engages an upper facing surface of said first blank proximate said first edge of said first blank to grip said first blank proximate said first edge, to a third position whereby said first edge of said first blank is lifted and peeled from said first edge of said second blank.

10. An apparatus as claimed in claim 9 wherein first and second blanks comprise first, second, third and fourth corners, said first, second, third and fourth corners of said first blank being aligned with said first, second, third and fourth corners of said second blanks, and said pick up apparatus comprise first, second, third and fourth edge lifting devices which include first, second, third and fourth vacuum suction cups, respectively, each of said first second, third and forth vacuum suction cups being mounted on a reciprocating cylinder, and each of said cylinders being mounted to said pick up apparatus frame, each of said first, second, third and fourth suction cups being movable by its respective reciprocating, cylinder, from a first position remote from one of first, second, third corner of said first blank, to a second position which engages an upper surface of said first blank proximate said one of said first, second, third and fourth corners of said first blank to grip said fist blank proximate said first, second, third and fourth corners, to a third position whereby said first, second, third and fourth corners of said first blank are lifted and peeled from said first, second, third and fourth corners of said second blank.

11. An apparatus as claimed in claim 1 wherein each of said first and second blanks has first and second opposed side edges, said first and second blanks having side edges of said first blank are substantially aligned with the side edges of said second blank, said nozzle assembly comprising first and second opposed nozzle banks, said first nozzle bank comprising said first nozzle and said second nozzle, and said second nozzle bank comprising third and fourth nozzles, said third nozzle and said fourth nozzle configured and operating like said first and second nozzles, said first nozzle bank positioned proximate said first side edges and said second nozzle bank positioned proximate said second side edges.

12. An apparatus as claimed in claim 7, wherein said suction cup applies a free substantially normal to said upper facing surface of said first blank as said vacuum suction cup moves from said second position to said third position.

13. An apparatus as claimed in claim 8, wherein said suction cap is mounted to said frame by a coupling assembly allowing said suction cup to move relative to said frame.

14. An apparatus as claimed in claim 1 further comprising a lift table for moving said stack relative to said air nozzle assembly to align said first and second blanks relative to said first and second nozzles.

15. The apparatus of claim 1 wherein said first and second blanks are magnetically chargeable, and further comprising a magnetic separation assembly being movable relative to said first and second blanks to position said first and second blanks proximate said magnetic separation assembly, said magnetic separation assembly comprising at least one magnet adapted to charge the edges of said first and second blanks, causing said first and second blanks to repel each other to assist said blank pickup apparatus in separating said first blank from said second blank through the application of magnetic force on said blanks.

16. The apparatus of claim 1, wherein said pick up apparatus further comprises an edge lifting device, operable to lift said edge of said first blank from said edge of said second blank; and said pick up apparatus operable to be positioned proximate said first blank to pick up said first blank once said edge lifting device has lifted said edge of said first blank from said edge of said second blank;

whereby said first blank can be separated from said second blank by said pick up apparatus also assisted by said edge lifting device.

17. The apparatus of claim 16 wherein said first and second blanks are magnetically chargeable, and further comprising a magnetic separation assembly being movable relative to said first and second blanks to position said first and second blanks proximate said magnetic separation assembly, said magnetic separation assembly comprising at least one magnet adapted to charge said side edges of said first and second blanks, causing said first and second blanks to repel each other to assist said pickup apparatus in separating said first blank from said second blank through the application of magnetic force on said blanks.

18. An apparatus for separating at least one blank from a stack of blanks comprising a first blank and a second blank positioned beneath said first blank, said apparatus comprising:

a frame;

an air nozzle assembly mounted to said frame, said air assembly nozzle comprising a first pressure nozzle discharging air at a first pressure and a second pressure nozzle able to discharging air at a second pressure, said first and second pressures higher than ambient pressure, and said first pressure being greater than said second pressure;

a first pickup apparatus movably mounted to said frame operable to apply a first force at the edge of said first blank so as to separate said first blank from said second blank;

a second pickup apparatus movably mounted to said frame operable to apply a second force to the interior of said first blank so as to assist said first pick up apparatus in separating said first blank from said second blank;

said first and second pickup apparatuses positioned proximate the upward facing surface of said first blank and movable from a first position to engage said first blank of said stack and a second position a distance from the upper surface of said stack of blanks; and said air nozzle assembly positioned proximate to the edges of said blanks of said stack of blanks and said air nozzle assembly and said stack of blanks being movable relative to each other and said air nozzle assembly positioned to assist in the separation of said first blank from said blank by directing pressurized air at said first pressure and said second pressure at the edge of said first blank;

whereby said edge of said first blank is separated from said second blank prior to said interior of said first blank being separated from the interior of said second blank.

19. The apparatus of claim 18 wherein said second pickup apparatus is operable to apply to said second force first applied in a direction opposite to said first force and then apply said second force in the same direction as said first force.

20. The apparatus of claim 18 wherein the amplitude said first force is greater than the amplitude of said second force and both said first and second forces ire applied in the same direction.

21. The apparatus of claim 18 wherein the first and second pickup apparatuses each comprise a plurality of suction nozzles.

22. The apparatus of claim 21 further comprising:

at least one magnetic separation assembly movably mounted to said frame and moveable from a position some distance away from said stack of blanks to a position proximate to said interface of said first and second blanks operable to induce a magnetic repulsion in said first and second blanks.

23. An apparatus for separating a first blank from a stack of blanks comprising said first blank and a second blank positioned beneath of said first blank, said apparatus comprising:

first means to direct a pressurized fluid at a first pressure and second means to direct a pressurized fluid at a second pressure;

a source of pressurized fluid in communication with said first and second means to direct said pressurized fluid at said first and second pressures, respectively;

a pick up means for picking up said first blank when said first blank is located proximate thereto;

said means to direct said pressurized fluid positioned to direct pressurized fluid at said first pressure and a second pressure at said side edges of said first blank and said second blank;

said pick up means operable to be positioned proximate said first blank to pick up said first blank, said source of pressurized fluid supplying said first and second means to direct pressurized fluid with pressurized fluid which is directed at said first and second pressures at the side edges of said first and second blanks to assist said pick up apparatus in separating said first blank from said second blank;

whereby said first blank can be separated from said second blank by said pick up means assisted by pressurized fluid emitted from said first and second means for directing pressurized fluid.

24. An apparatus as claimed in claim 23 wherein said fluid is comprised of at least one pressurized gas.

25. An apparatus as claimed in claim 23 wherein said second pressure is directed at said side edges of said first and second blanks after said first pressure is directed at said side edges of said first and second blanks.

26. An apparatus as claimed in claim 25 wherein said first means for directing a pressurized fluid directs air at an edge of said first blank proximate said nozzle to cause the side edge of said first blank to ripple, thereby creating at least a partial gap between said first blank and said second blank.

27. An apparatus as claimed in claim 25 wherein said first and second blank each have at least one edge, said edge of said first blank and said edge of said second blank being substantially aligned one above the other, and wherein said pick up means further comprises an edge lifting device, operable to lift said edge of said first blank away from said edge of said second blank.

28. An apparatus as claimed in claim 27 wherein said first blank has an upward facing surface, and said pick up means also comprises a means for applying a force tending to push said first blank against said second blank at a medial portion of the upward facing surface of said first blank remote from said edge of said first blank, thereby assisting in the lifting of said edge by said edge lifting device.

29. An apparatus as claimed in claim 6 wherein said edge lifting device is continually operable to lift said edge of said first from said edge of said second blank as said edge of said first blank flexes.

30. The apparatus of claim 1 wherein said pressurized fluid is directed at said edges of said first blank at said first pressure through said first nozzle for a first time period and said pressurized fluid is directed at said second pressure through said second nozzle for a second time period.

31. The apparatus of claim 1 wherein said pressurized fluid emitted from said second nozzle is directed at a gap formed between said first blank and said second blank.

32. The apparatus of claim 30 wherein said second time period is longer than said first time period.

33. The apparatus of claim 31 wherein said second time period is longer than said first time period.

34. The apparatus of claim 31 wherein said second time period overlaps with said first time period.

35. The apparatus of claim 1 wherein said first source of pressurized fluid and said second source of pressurized fluid are derived from a common source.

36. The apparatus of claim 30 further comprising a third source of pressurized fluid in communication with a third pressure nozzle and providing pressurized fluid to said third nozzle to be emitted at a third pressure, said third pressure nozzle operable to direct said pressurized fluid at said side edge of said first blank at said third pressure to assist said first pressure nozzle in creating a gap between said first blank and said second blank.

37. The apparatus of claim 34 wherein said third pressure nozzle directs air at an incline such that said pressurized fluid tends to push said first blank away from said second blank.

38. An apparatus as claimed in claim 1 wherein said first pressure is in the range of about 60–160 psi and said second pressure is in the range of about 40–120 psi.

39. An apparatus as claimed in claim 18 wherein said first pressure is in the range of about 60–160 psi and said second pressure is in the range of about 40–120 psi.

40. An apparatus as claimed in claim 1 further comprising a controller for controlling the flow of pressurized fluid to each of said first pressure nozzle and said second pressure nozzle.

41. An apparatus as claimed in claim 40 further comprising a first valve operable by said controller for controlling the flow of said pressurized fluid to said first pressure nozzle and a second valve operable by said controller for controlling the flow of said pressurized fluid to said second pressure nozzle.

42. An apparatus as claimed in claim 30 wherein said first period of time overlaps, at least partially, said second period of time.

* * * * *

UNITED STATES PATENT AND TRADEMARK OFFICE

CERTIFICATE OF CORRECTION

PATENT NO. : 6,468,025 B1
DATED : October 22, 2002
INVENTOR(S) : Stumpf et al.

It is certified that error appears in the above-identified patent and that said Letters Patent is hereby corrected as shown below:

Column 11,
Line 57, “sad” should read -- said --.
Line 67, “firer” should read -- Further --.

Column 12,
Line 39, delete the comma following “reciprocating”.

Column 14,
Line 16, “ire” should read -- are --.

Column 15,
Line 2, “blank” should read -- blanks --.

Signed and Sealed this

Twenty-seventh Day of December, 2005

JON W. DUDAS
*Director of the United States Patent and Trademark Office*